US008146382B2

(12) United States Patent
Villasante

(10) Patent No.: US 8,146,382 B2
(45) Date of Patent: Apr. 3, 2012

(54) PACKAGING SYSTEM FOR STORING AND/OR TRANSPORTING DIFFERENT KIND OF FRUITS DURING LONG PERIODS OF TIME

(75) Inventor: Juan Jose Villasante, Santiago (CL)

(73) Assignee: Inversiones Sestri S.A., Santiago (CH)

( * ) Notice: Subject to any disclaimer, the term of this patent is extended or adjusted under 35 U.S.C. 154(b) by 784 days.

(21) Appl. No.: 12/278,375

(22) PCT Filed: Mar. 21, 2006

(86) PCT No.: PCT/EP2006/060915

§ 371 (c)(1),
(2), (4) Date: Dec. 9, 2008

(87) PCT Pub. No.: WO2007/090469

PCT Pub. Date: Aug. 16, 2007

(65) Prior Publication Data

US 2009/0218344 A1 Sep. 3, 2009

(30) Foreign Application Priority Data

Feb. 6, 2006 (CL) ..... 257-2006

(51) Int. Cl.
*F25D 17/06* (2006.01)

(52) U.S. Cl. ..... 62/419; 62/438

(58) Field of Classification Search ..... 62/78, 329, 62/419, 438; 99/474, 467, 486
See application file for complete search history.

(56) References Cited

U.S. PATENT DOCUMENTS

| | | | | |
|---|---|---|---|---|
| 4,491,231 | A * | 1/1985 | Heggeland et al. | 220/6 |
| 4,646,928 | A | 3/1987 | Ono et al. | |
| 4,684,034 | A | 8/1987 | Ono et al. | |
| 4,726,486 | A * | 2/1988 | Masuda | 220/1.5 |
| 5,199,729 | A | 4/1993 | Sievert et al. | |
| 5,267,663 | A * | 12/1993 | Dykhouse | 220/4.28 |
| 5,562,228 | A * | 10/1996 | Ericson | 62/457.2 |
| 5,872,721 | A | 2/1999 | Huston et al. | |
| 6,254,112 | B1 * | 7/2001 | Clegg | 280/47.19 |
| 6,457,402 | B1 * | 10/2002 | Parker et al. | 99/475 |
| 6,615,908 | B1 | 9/2003 | Bosher et al. | |
| 7,339,493 | B2 * | 3/2008 | El Zabadani et al. | 340/12.5 |

(Continued)

FOREIGN PATENT DOCUMENTS

DE 43 20 507 A1 12/1994

(Continued)

OTHER PUBLICATIONS

International Search Report of PCT/EP2006/060915, dated Nov. 7, 2006.

*Primary Examiner* — Mohammad Ali
(74) *Attorney, Agent, or Firm* — Hamre, Schumann, Mueller & Larson, P.C.

(57) ABSTRACT

The present invention relates to a packaging system for storing and/or transporting different kind of fruits packaged in clamshell, punnets or trays during long periods of time, comprising a collapsible structure including four vertical columns with side walls collapsible on a pallet-type base, exhibiting an arrangement of internal trays or grids, and wrappable curtains configuring front and rear walls, such that it doesn't require the use of cardboard, wood or plastic boxes; preferably the system also comprises cooling means, gas-generating means and controlling means.

12 Claims, 3 Drawing Sheets

U.S. PATENT DOCUMENTS

| | | | | |
|---|---|---|---|---|
| 2002/0096844 | A1* | 7/2002 | Clegg | 280/47.17 |
| 2004/0089208 | A1* | 5/2004 | Zheng | 108/165 |
| 2004/0100380 | A1 | 5/2004 | Lindsay et al. | |
| 2007/0051720 | A1* | 3/2007 | Chen | 220/6 |

FOREIGN PATENT DOCUMENTS

| | | | |
|---|---|---|---|
| DE | 299 06 231 | U1 | 8/1999 |
| DE | 10 2004 004 960 | A1 | 12/2004 |
| EP | 0 255 194 | A2 | 2/1988 |
| EP | 1 277 673 | A1 | 7/2002 |
| EP | 1 477 630 | A2 | 8/2004 |
| JP | 10-205983 | A | 8/1998 |
| WO | WO 95/12513 | A1 | 5/1995 |
| WO | WO 95/22728 | A1 | 8/1995 |

* cited by examiner

PACKAGING SYSTEM FOR STORING AND/OR TRANSPORTING DIFFERENT KIND OF FRUITS DURING LONG PERIODS OF TIME

The present invention relates to a packaging system for storing and/or transporting different kind of fruits packaged in clamshell, punnets or trays during long periods of time, without using current cardboard, wood or plastic boxes; specifically, this invention relates to a system comprising a structure of side walls collapsible on a pallet-type base having inner trays arranged therein and a closure exhibiting front curtains, cooling means and gas-generating means.

FIELD OF THE INVENTION

Perishable products are transported by road, sea, rail and air using a variety of different techniques. In said techniques it is of great importance the refrigeration and the use of a controlled atmosphere, which improves the product preservation.

A feature of current technology is the trend toward the use of standard-size refrigerator containers which can be handled by equipments placed inside the used transport means.

The patent document U.S. Pat. No. 6,615,908 B1 (Bosher et al.) titled "Method of transporting or storing perishable produce", describes a method allowing cool rooms or sea containers designed for frozen goods to handle a product, more precisely controlled temperatures and conditions. Each load of produce of pallet size is sealed by a wrapping or plastic bag. The atmosphere within the bag is re-circulated by a fan and distributed so as to pass through ducts adjacent the bag, which maintain the packaged product in cardboard boxes. However, this kind of transport uses a packaging form resulting in several additional costs for the fruit exporters whether due to the amount of different material used inside the box (such as bags, papers, generator, etc.) or to the use of a double package: a clamshell and then box (wood pallets, corner cupboard, iron straps, etc.).

The present invention solves said problems, since it provides a transport and/or storage system comprising a main collapsible, metallic or plastic structure, whose inner part has a determined amount of divisions or separations allowing to storage and transport different kind of fruits packaged in clamshell, punnets or trays during long periods of time, without using current cardboard, wood or plastic boxes.

DETAILED DESCRIPTION OF THE INVENTION

Figure 1:
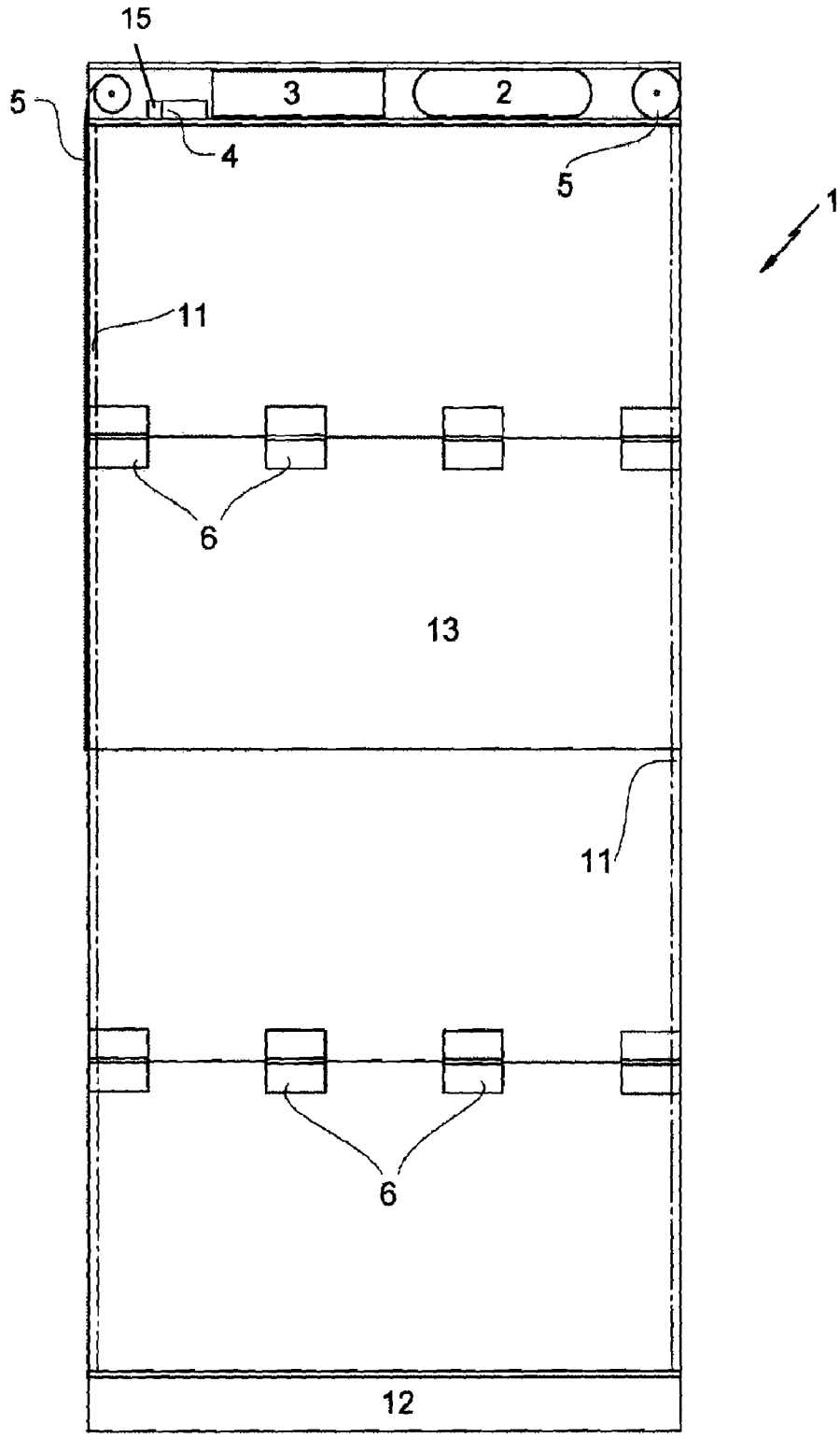
FIG. 1 shows a side elevation view of the system according to the present invention.
Figure 2:
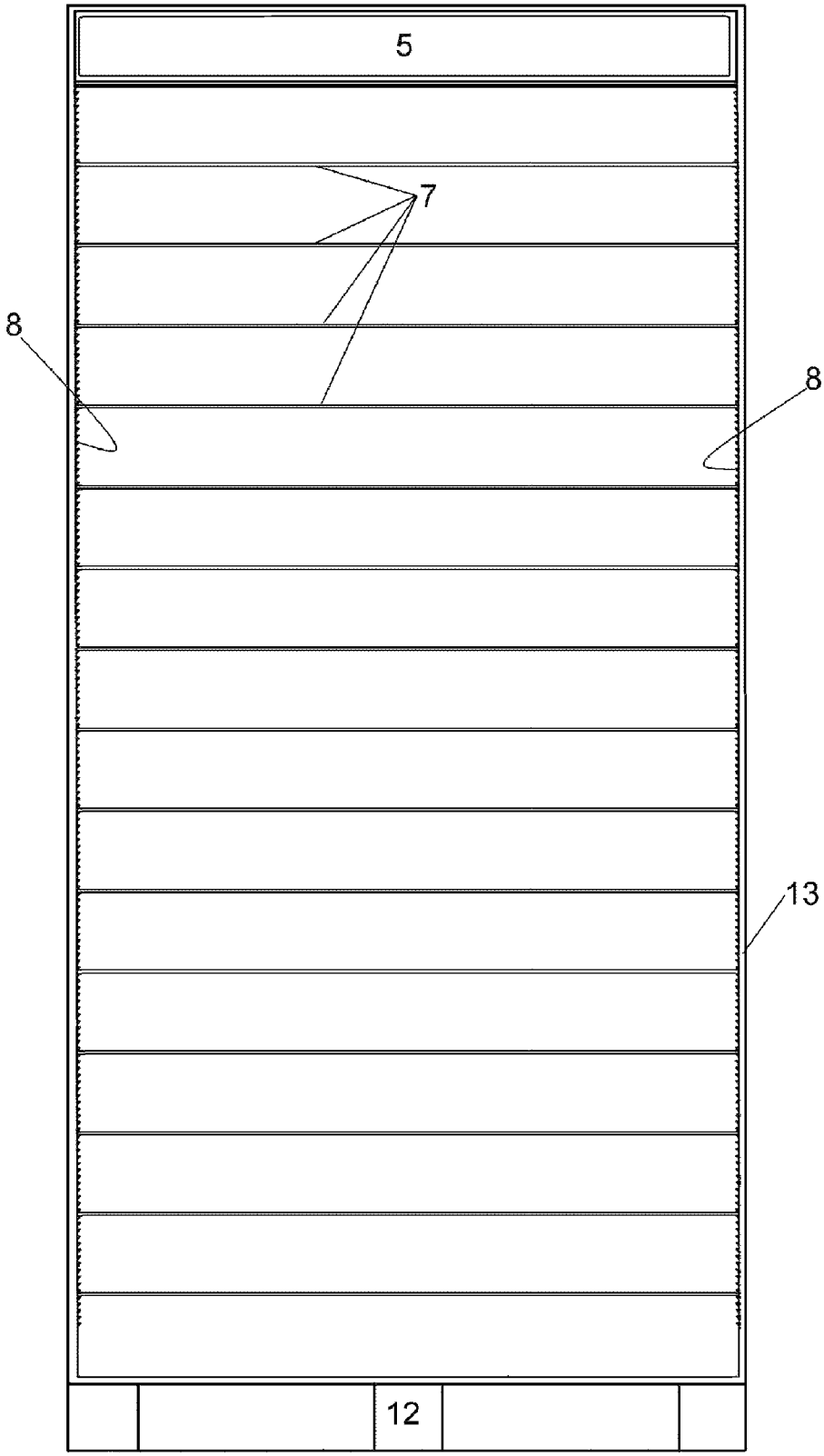
FIG. 2 shows a front view of the system according to the present invention.
Figure 3:
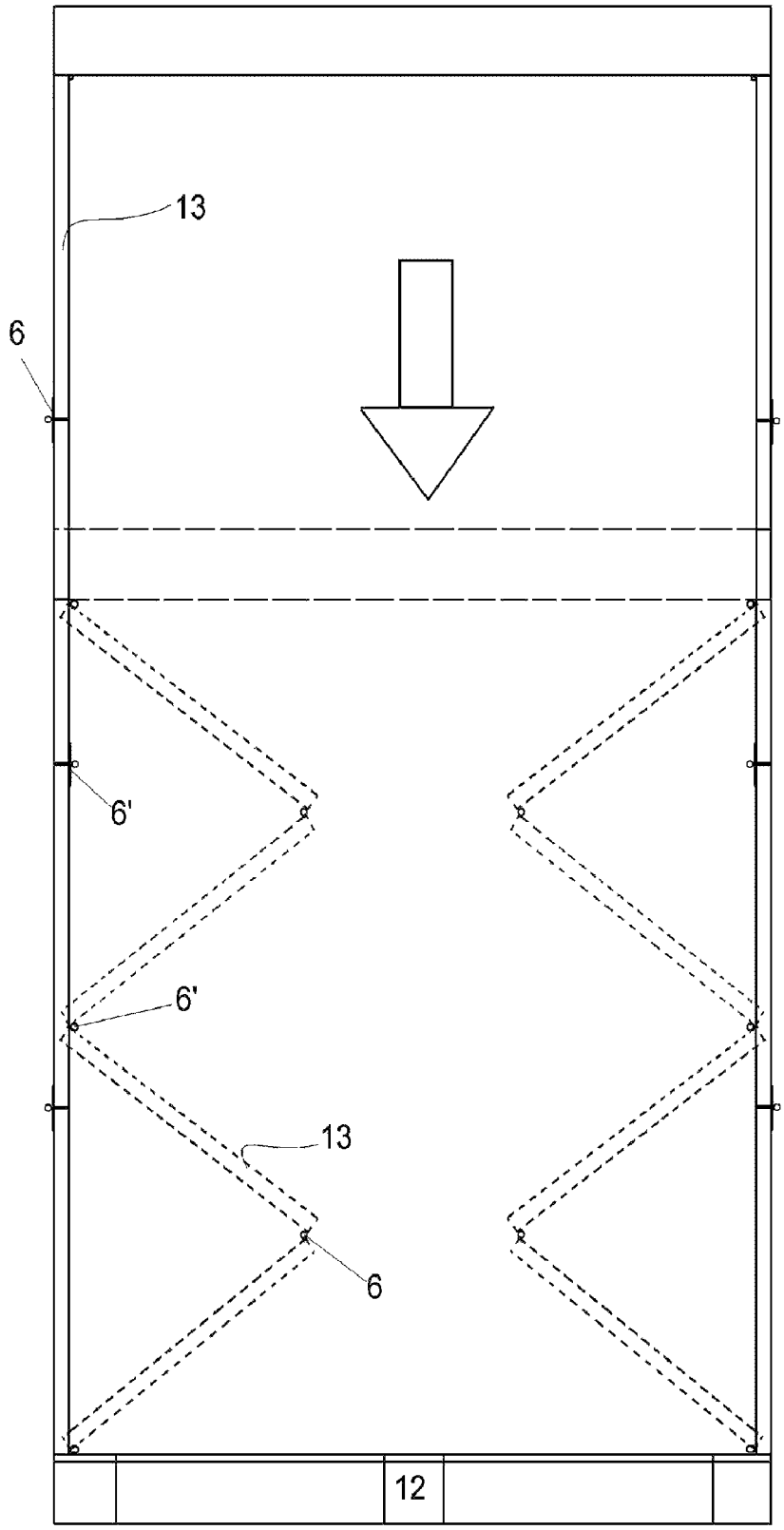
FIG. 3 shows an operation schema of the fold of this system.

The transport and/or storage system (1) consists of a structure of metal, plastic, cardboard, wood or of any other material or a mixture thereof, where said structure consists of four vertical columns (11) placed on pallet-type base (12) corners and collapsible side walls (13) made up of solid and insulating material, being said vertical columns (11) also collapsible in horizontal direction (see FIG. 3). This collapsible structure is achieved by disposing external hinges (6) on the external surface of the side faces (13) so as to provoke a break toward the outside of the collapsible structure, and by disposing internal hinges (6') on the internal surface of the side faces (13) in order to provoke a break toward the inside of the collapsible structure, such that said hinges (6 and 6') result in horizontal lines, which are alternated between the internal surface and the external surface of said side walls (13). Between each hinge line (6 and 6') there is a distance of about 500 mm and 580 mm, so as to achieve a dismounted structure comprised by the surface of the pallet-type base (12).

In an embodiment of the invention, this structure has a head, wherein a cooling device (3), a gas-generating device (2), a control device (4) and cylindrical means are provided in the front and rear end of the structure head, which allows to wrap a curtain (5), wherein said wrappable curtain forms front and rear walls of the system (1).

In a preferred embodiment of the invention, the internal surface of side faces (13) exhibits grooves or rails (8) for disposing a plurality of slippable trays (7) or simply grids, where clamshell with packaged products are placed. Said grooves or rails (8) permit to dispose trays (7) at different heights, if required.

In order to effectively reach the products on trays (7) the gas-generating system (2) is provided with pipes or ducts (not shown) of about 3-5 mm diameter, which are arranged throughout column height, immediately behind rails (8), so as to permit the gas passage generated, for example, by a diffusing device.

The cooling device (3) permits maintain the temperature required by the packaged products during the transport and storage thereof.

The system (1) of the present invention exhibits temperature-fluctuation impenetrability regarding the atmosphere due to the wrappable curtains (5) placed in the front and rear opposite faces, which are stored by wrapping the same on cylindrical means placed at each end of the head. Said wrappable curtains are also made up of insulating material, if required.

In an embodiment of the invention, said wrappable curtains (5) are of grid-type, when there is no thermal insulation required.

For a good operation of the cooling device (3) and the gas-generating one (2) it is necessary to count with a controller (4) also placed in the structure head, which maintains the optimal preservation conditions. This controller is a processor (15) with RFID (Radio Frequency Identification) system, which comprises memory, wherein more variables can be stored, such as quantity, origin, weight, variety, producer, etc. of the packaged product disposed on trays (7) in the inside of the system (1) of the present invention, thus improving products design. For this purpose special software is developed.

The advantage of the system collapsible structure is the re-use of the same, thus considerably diminishing its volume when the same is empty or without load, permitting the transport thereof in a more efficient manner.

The system (1) of the present invention permits a solid and rigid structure when it is in operation, which facilitates storage of a plurality of said systems by simply piling up one above another, thus increasing the capacity of firms' storage chambers.

This structure is collapsible so as to be used over and over again, thus permitting a more efficient transport thereof, when it is without fruit (not in use).

The invention claimed is:

1. A packaging system for storing and/or transporting packaged fruits for long periods of time, comprising:

a) a collapsible structure including four collapsible vertical columns and collapsible side walls mounted on a pallet-type base and defining an interior space, a head, and wrappable curtains that when deployed form front and rear walls of the collapsible structure, the collapsible structure further including an arrangement of internal trays or grids removably disposed within the interior space on which packaged fruits can be located;

b) a cooling device located on the head that helps maintain the temperature required by packaged fruits within the interior space of the collapsible structure;

c) a gas generating device located on the head and arranged to deliver gas to packaged fruits within the interior space of the collapsible structure; and d) a controller with a processor located on the head that maintains optimum conditions of packaged fruits within the interior space of the collapsible structure.

2. The packaging system for storing and/or transporting packaged fruits according to claim 1, wherein the vertical columns are placed on corners of the pallet-type base.

3. The packaging system for storing and/or transporting packaged fruits according to claim 1, wherein the vertical columns and side walls comprise:

external hinges on the external surface so as to permit a break toward the outside of the collapsible structure, and internal hinges on the internal surface in order to permit a break toward the inside of the collapsible structure, and said internal and external hinges result in horizontal lines that are alternated between the internal surface and the external surface of said side walls.

4. The packaging system for storing and/or transporting packaged fruits according to claim 1, wherein internal faces of the collapsible side walls include a plurality of grooves or rails on which the trays or grids can be horizontally arranged, and said trays or grids are arranged at similar or different heights therebetween.

5. The packaging system for storing and/or transporting packaged fruits according to claim 1, wherein the wrappable curtains are stored by wrapping the wrappable curtains on cylinders placed at each end of the head of the collapsible structure.

6. The packaging system for storing and/or transporting packaged fruits according to claim 1, wherein the collapsible side walls and wrappable curtains are made up of thermally insulating material.

7. The packaging system for storing and/or transporting packaged fruits according to claim 1, wherein the cooling device, the gas generating device, and the controller are arranged in the head of the collapsible structure.

8. The packaging system for storing and/or transporting packaged fruits according to claim 5, wherein said head includes an upper wall, a lower wall, side walls that form a continuation of the side walls of the collapsible structure, and rear and front walls that are formed at least partially by the wrappable curtains.

9. The packaging system for storing and/or transporting packaged fruits according to claim 4, further comprising pipes or ducts connected to the gas generating device and placed behind the grooves or rails.

10. The packaging system for storing and/or transporting packaged fruits according to claim 1, wherein the controller includes an RFID (Radio Frequency Identification) system and a memory where identification parameters of the packaged fruits product can be stored.

11. The packaging system for storing and/or transporting packaged fruits according to claim 1, wherein said wrappable curtains are of grid-type.

12. The packaging system for storing and/or transporting packaged fruits according to claim 1, wherein the pallet-type base and the head are located at opposite ends of the collapsible vertical columns and the collapsible side walls from one another, the pallet-type base is located at a bottom of the collapsible structure and the head is located at a top of the collapsible structure.

* * * * *